US007428805B2

(12) United States Patent
Kim

(10) Patent No.: US 7,428,805 B2
(45) Date of Patent: Sep. 30, 2008

(54) SEMI-AUTOMATIC MEDICINE PACKAGING MACHINE

(75) Inventor: Jun Ho Kim, Daegu (KR)

(73) Assignee: JVM Co., Ltd., Taegu (KR)

( * ) Notice: Subject to any disclaimer, the term of this patent is extended or adjusted under 35 U.S.C. 154(b) by 0 days.

(21) Appl. No.: 11/837,792

(22) Filed: Aug. 13, 2007

(65) Prior Publication Data

US 2008/0172990 A1 Jul. 24, 2008

(30) Foreign Application Priority Data

Jan. 19, 2007 (KR) ..... 10-2007-0006114

(51) Int. Cl.
*B65B 61/26* (2006.01)

(52) U.S. Cl. ..... 53/131.4; 53/255; 53/284.7

(58) Field of Classification Search ..... 53/55, 53/131.4, 247, 255, 284.7, 570; 221/24, 221/67, 69, 92, 154, 155, 282; 235/382
See application file for complete search history.

(56) References Cited

U.S. PATENT DOCUMENTS 6,170,699 B1 * 1/2001 Kim ..... 221/85
6,179,205 B1 * 1/2001 Sloan ..... 235/382
6,273,335 B1 * 8/2001 Sloan ..... 235/382
6,540,101 B1 * 4/2003 Kim ..... 221/25
6,581,356 B2 * 6/2003 Kim ..... 53/154
7,331,151 B2 * 2/2005 Kim ..... 53/131.4
6,898,919 B2 * 5/2005 Kim ..... 53/131.4
7,028,447 B2 * 4/2006 Sung ..... 53/131.5
7,059,098 B2 * 6/2006 Kim ..... 53/131.4
2002/0092275 A1 * 7/2002 Kim ..... 53/253
2003/0057225 A1 * 3/2003 Kim ..... 221/92
2004/0046020 A1 * 3/2004 Andreasson et al. ..... 235/385
2004/0182044 A1 * 9/2004 Kim ..... 53/131.4
2007/0016327 A1 * 1/2007 Yuyama et al. ..... 700/231
2007/0151204 A1 * 7/2007 Kim ..... 53/55
2007/0208595 A1 * 9/2007 Ohmura et al. ..... 705/2

* cited by examiner

*Primary Examiner*—Louis K Huynh
(74) *Attorney, Agent, or Firm*—John K. Park; Park Law Firm

(57) ABSTRACT

A semi-automatic medicine packaging machine includes a medication feed outlet that feeds and discharges medications into a hopper, a sealing unit that seals medications in the hopper by medication envelope(s) on which instruction labels are printed by a printing unit, a button operation unit that inputs a user's operation into the controller, a manual dispensing tray, an automatic supply unit including a plurality of tablet cassettes, and a user information input unit that inputs user information into a controller that controls the overall operation of the machine and includes a user authentication unit for authenticating a user.

13 Claims, 8 Drawing Sheets

SEMI-AUTOMATIC MEDICINE PACKAGING MACHINE

CLAIMING FOREIGN PRIORITY

The applicant claims and requests a foreign priority, through the Paris Convention for the Protection of Industrial Property, based on patent applications filed in the Republic of Korea (South Korea) with the filing date of Jan. 19, 2007, with the patent application number 10-2007-0006114 by the applicant, the contents of which are incorporated by reference into this disclosure as if fully set forth herein.

BACKGROUND OF THE INVENTION

The present invention relates to a semi-automatic medicine packaging machine that packages each dose of medication manually dispensed by a user or a pharmacist. Specifically, the present invention relates to the semi-automatic medicine packaging machine that improves packaging efficiency and speed by supplying an automatic supply unit and prevents an unauthorized person from operating the semi-automatic medicine packaging machine through user authentication.

In general, a semi-automatic medicine packaging machine, which is provided to small pharmacies or other similar places, continuously packages each dose of tablet-type medication manually dispensed by a user or a pharmacist. In contrast to the semi-automatic medicine packaging machine, there is an automatic medicine packaging machine, which is provided to big hospitals or other similar places, that continuously packages each dose of medication through prescription data input.

Referring to FIG. 6 and FIG. 8, the semi-automatic medicine packaging machine of prior art includes a medication feed outlet 300 that feeds medications dispensed into a manual dispensing tray 200 established on the upper part of a body 100 and discharges medications to a hopper 400, a sealing unit 600 that feeds and seals tablets in the hopper 400 by tablet envelope(s) on which instruction labels are printed by a printing unit 500, a controller 700 which controls the medication feed outlet 300, the printing unit 500, and the sealing unit 600, a button operation unit 800 that is established on a side of the upper part of the body 100 and inputs user's operation command into the controller 700, a plurality of cassettes stands 900 on the upper part of the body 100, and a plurality of tablet cassettes 901 on the upper part of the cassettes stands 900.

In the semi-automatic medicine packaging machine, a user or a pharmacist compounds prescription by dispensing each dose of medication into the manual dispensing tray 200, and those medications fall freely from the manual dispensing tray 200 into the medication feed outlet 300 at one time.

The each dose of medication fallen into the medication feed outlet 300 are discharged into the hopper 400 by operation of the medication feed outlet 300 which is controlled by the controller 700, and then the each dose of medication is exported to medication envelope(s), on which instructions are printed by the printing unit 500, to form a medication package by heat-sealing process of the healing unit 600.

The sequential performance of the above process makes medication packages which are manually prescription compounded by a pharmacist. The tablet cassettes 901 which are controlled by the controller 700 plays a role of discharging each tablet housed in the interior of the tablet cassettes 901 into the hopper 400. Therefore, frequently used medications may be housed in the tablet cassettes 901 and make medication packages by combining manually dispensed medications with medications in the tablet cassettes 901. Each tablet housed in the tablet cassettes 901 is discharged into the hopper 400 by being rotated by rotators 903 driven by motors 902 established in the cassettes stands 900.

However, the semi-automatic medicine packaging machine by the above prior art has a disadvantage that packaging efficiency and speed are considerably low compared to automatic medicine packaging machine because of almost manual packaging due to shortage in number of tablet cassettes established on the upper part of the body.

Another disadvantage of the semi-automatic medicine packaging machine is that packaging may be done by an unauthorized user because anybody, not necessarily an authorized person, may perform medicine packaging.

Still another disadvantage of the semi-automatic medicine packaging machine is that the semi-automatic medicine packaging machine is inconvenient to use because a user can not smoothly recognize overall information of the packaging machine, that is, information on current operational state of the semi-automatic medicine packaging machine, on medications for making packages.

Still another disadvantage of the semi-automatic medicine packaging machine is that manual dispensing is inconvenient because there is no collection space for collecting and preserving medications that will be used in case of manual prescription compounding of a pharmacist.

SUMMARY OF THE INVENTION

The present invention contrives to solve the above disadvantages of the prior art. An objective of the invention is to provide a semi-automatic medicine packaging machine that improves packaging efficiency and speed by supplying an automatic supply unit and prevents the supplement and outflow of tablets by an unauthorized person and makes tablets kept and treated more safely.

Another objective of the invention is to provide a semi-automatic medicine machine that smoothly recognizes overall information of the packaging machine, that is, information on current operational state of the semi-automatic medicine packaging machine, on medications for making packages.

Still another objective of the invention is to provide a semi-automatic medicine machine that has a useful collection space for collecting and preserving medications, so that usage convenience is improved through collection of medications.

Still another objective of the invention is to provide an automatic medicine packaging machine that prevents supplement or outflow of tablets by an unauthorized person and makes tablets kept and treated more safely.

Still another objective of the invention is to provide an automatic medicine packaging machine in which the door can be opened or closed by manual operation in case of power failure and the convenience of usage may be improved due to manual operation.

Still another objective of the invention is to provide an automatic medicine packaging machine in which, by detecting opened or closed state of the glass door, locking of the glass door can be done more precisely and the state may be recognized by a user with ease.

Still another objective of the invention is to provide an automatic medicine packaging machine in which abnormal opening of the glass door will be prohibited and abnormal opening may be recognized by a user smoothly.

A semi-automatic medicine packaging machine including a medication feed outlet that feeds and discharges medications into a hopper, a manual dispensing tray, a sealing unit that seals medications in the hopper by medication envelope (s), a printing unit that prints data on the medication envelope (s), a controller that controls the medication feed outlet, the printing unit, and the sealing unit, and a button operation unit that inputs a user's operation into the controller includes: a shelf that is established on the rear upper part of the body having a glass door that is established on the open front of the body for opening or closing the front of the body and an outlet rearwards connected to the hopper; an automatic supply unit that discharges medications into the outlet according to operation of the controller including a plurality of cassette stands arrayed in the interior of the shelf and a plurality of tablet cassettes detachably established on the upper part of the cassette stands for housing medications; and a user information input unit that is established on the exterior of the body and inputs user information into the controller, in which the controller includes a user authentication unit that authenticates a user by comparing and analyzing user information inputted by the user information unit and information stored in advance.

The semi-automatic medicine packaging machine further includes an information display unit that is established on the front upper part of the shelf and displays information inputted from the controller.

The semi-automatic medicine packaging machine further includes a subsidiary shelf that is established on a side of the shelf as a state of being void and has a door on the front side.

The manual dispensing tray further includes a tray cover that is established on the upper part of the tray and is capable of being opened or closed.

The user information unit includes a card reader that is established on the front of the body and inputs user's card information.

The semi-automatic medicine packaging machine further includes a door lock unit that is established on the shelf and locks or unlocks the glass door according to the operation through the button operation unit by a user authenticated by the user authentication unit.

The door lock unit includes a driver that is established on the upper part of the shelf corresponding to the lower part of the glass door and controlled by the controller, an anchor member that locks or unlocks the glass door by being vertically moved by the driver.

The door lock unit further includes a groove member that is established on the upper part of the glass door corresponding to the lower part of the anchor member and makes the anchor member to be inserted into or pulled out of the groove member.

The door lock unit further includes a manual operation unit that locks or unlocks the door lock unit by manual operation of a user during power failure.

The manual operation unit includes an on/off switch that is established on the body as a state of being connected to the driver, a battery that is connected to the on/off switch and provides power to the driver, and a key operation unit that is exposed outside the body and controls the driver's operation of locking or unlocking by switching on or off power to be supplied to the driver through key operation.

The semi-automatic medicine packaging machine further includes an open/close detection sensor that is established on the upper part of the glass door of the body and inputs to the lock controller by detecting a state of the glass door's being locked or unlocked.

The semi-automatic medicine packaging machine further includes a beep generation unit that is connected to the lock controller and makes beep sounds for warning in case of abnormal opening of the glass door.

The semi-automatic medicine packaging machine further includes a user data storage unit that is connected to the lock controller and stores users' data which are information on users who are authenticated by the user authentication unit.

An advantageous effect of the present invention is that the semi-automatic medicine packaging machine improves packaging efficiency and speed by supplying an automatic supply unit and prevents supplement and outflow of tablets by an unauthorized person and makes tablets kept and treated more safely.

Another advantageous effect of the invention is that the semi-automatic medicine machine smoothly recognizes overall information of the packaging machine, that is, information on current operational state of the semi-automatic medicine packaging machine, on medications for making packages.

Still another advantageous effect of the invention is that the semi-automatic medicine machine has a useful collection space for collecting and preserving medications, so that usage convenience is improved through collection of medications.

Still another advantageous effect of the invention is that the semi-automatic medicine packaging machine prevents supplement and outflow of tablets by an unauthorized person and makes tablets kept and treated more safely.

Still another advantageous effect of the invention is that the semi-automatic medicine packaging machine allows the door can be opened or closed by manual operation in case of power failure and the convenience of usage may be improved due to manual operation.

Still another advantageous effect of the invention is that the semi-automatic medicine packaging machine allows, by detecting opened or closed state of the glass door, locking of the glass door can be done more precisely and the state may be recognized by a user with ease.

Still another advantageous effect of the invention is that the semi-automatic medicine packaging machine prohibits abnormal opening of the glass door and abnormal opening may be recognized by a user smoothly.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENT

Figure 1:
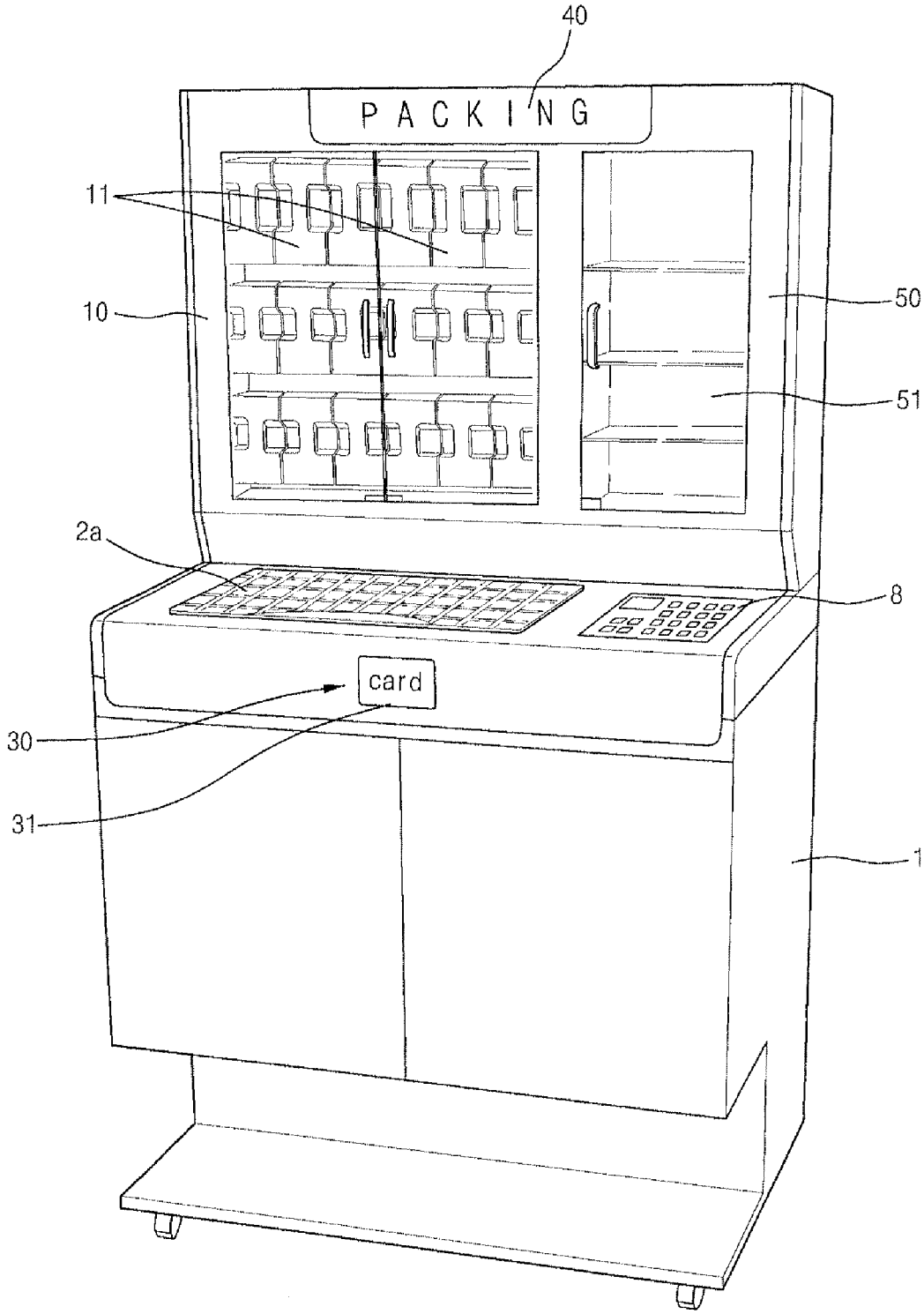
FIG. 1 is a perspective view of a semi-automatic medicine packaging machine according to the present invention.
Figure 2:
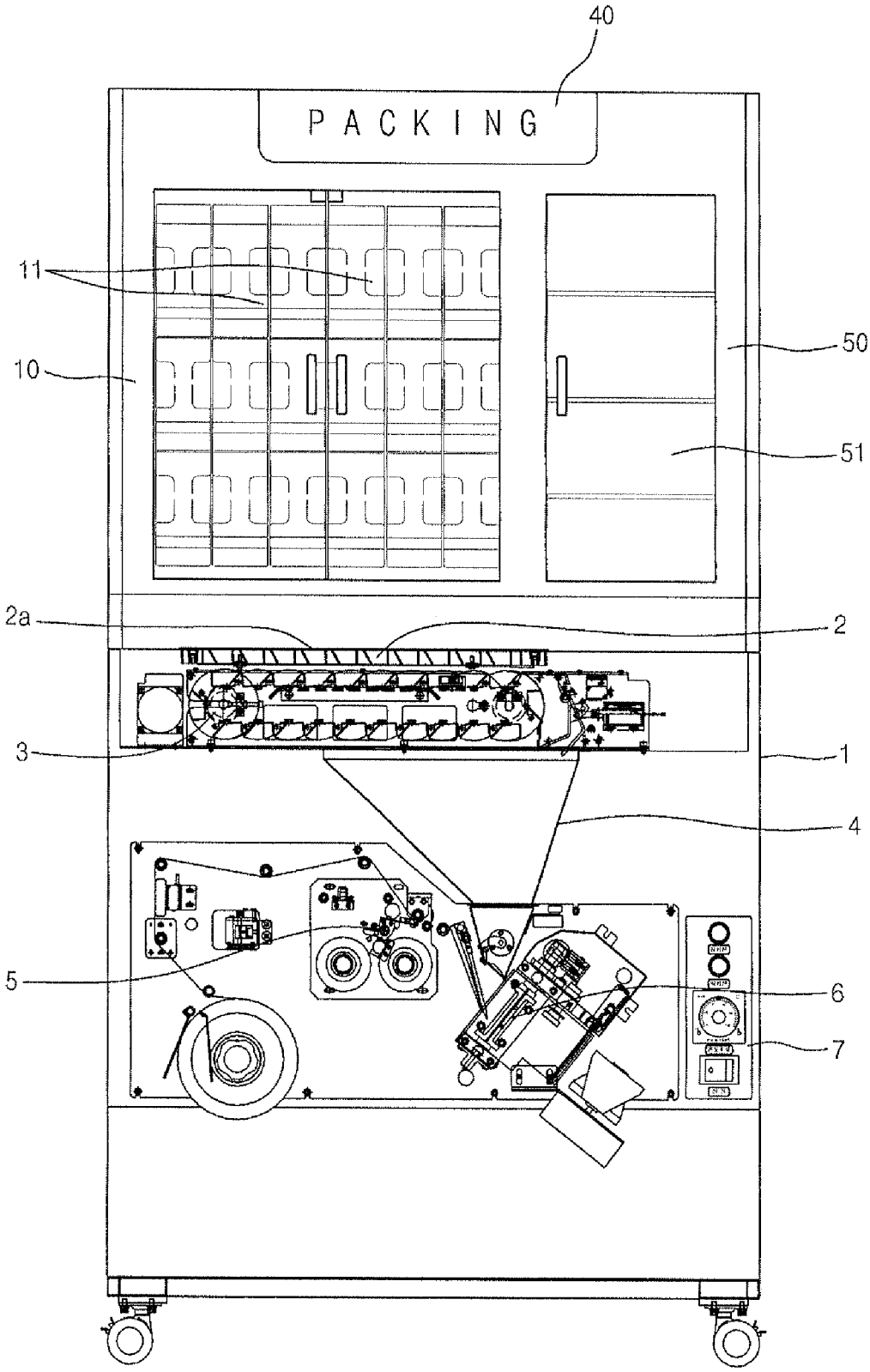
FIG. 2 is an elevation view of the semi-automatic medicine packaging machine.
Figure 3:
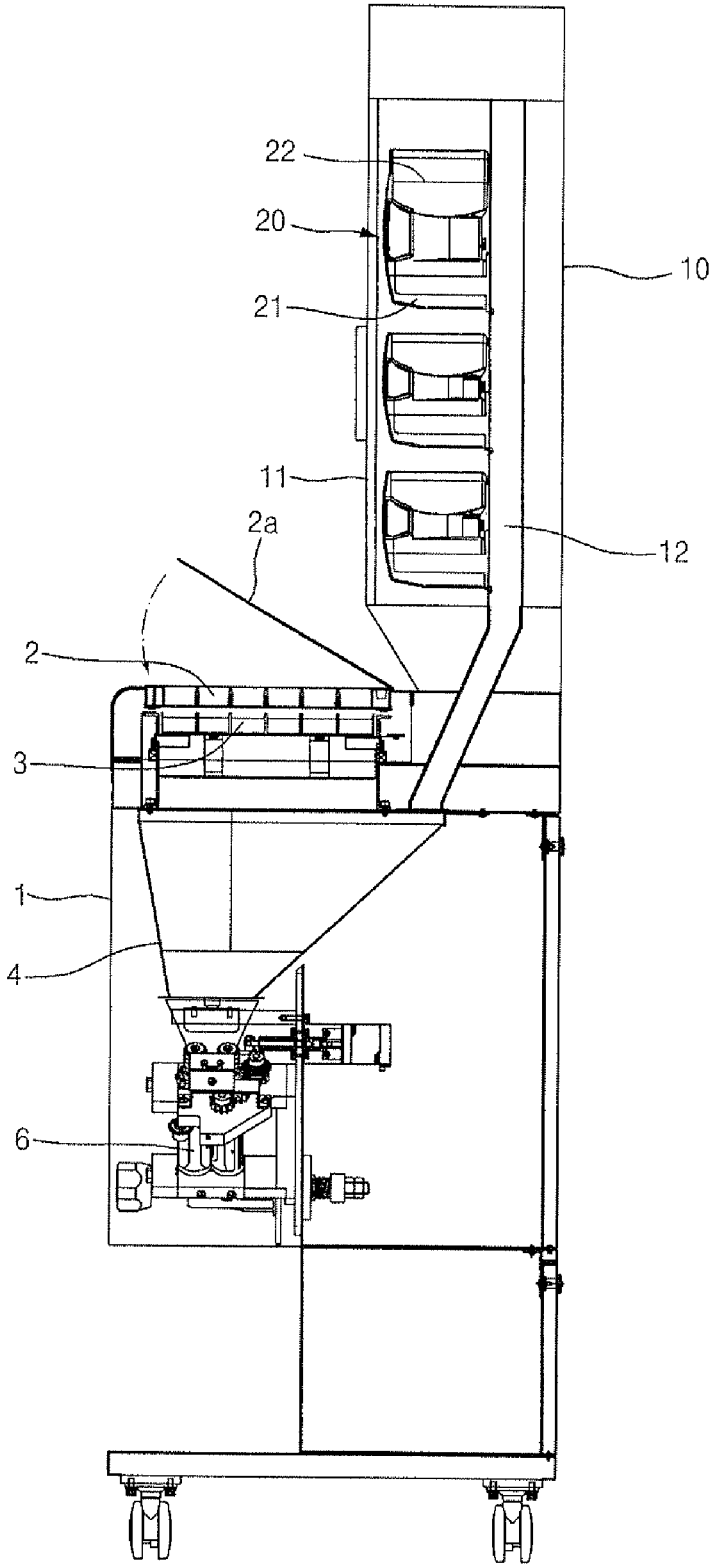
FIG. 3 is a side elevation view of the semi-automatic medicine packaging machine.

Referring to FIG. 1, FIG. 2, and FIG. 3, a semi-automatic medicine packaging machine includes a medication feed outlet 3 that feeds and discharges medications into a hopper 4, a manual dispensing tray 2, into which medications are dispensed, established on the upper part of a body 1, a sealing unit 6 that seals tablets in the hopper 4 by medication envelope(s), a printing unit 5 that prints data on medication envelope(s), a controller 7 that controls the medication feed outlet 3, the printing unit 5 and the sealing unit 6, and a button operation unit 8 that is established on a side of the upper part of the body 1 and inputs a user's operation into the controller 7.

The semi-automatic medicine packaging machine further includes a shelf 10 that is established on the rear upper part of the body 1, an automatic supply unit 20 that is arrayed in the interior of the front of the body 1, and a user authentication unit 30 that is established on the front of the body 1.

The shelf 10 has a glass door 11 that is established on the open front of the body 1 for opening or closing the front of the body 1 and an outlet 12 rearwards connected to the hopper 4 for letting tablets released from the automatic supply unit 20 fall freely to the hopper 4.

The automatic supply unit 20 discharges tablets to the outlet 12 of the shelf 10 according to the control of the controller 7 and includes a plurality of cassette stands 21 arrayed in the interior of the shelf 10 and a plurality of tablet cassettes 22 detachably established on the upper part of the cassette stands 21 for housing medications.

The cassettes stands 21 plays a role of supporting tablet cassettes arrayed on the upper part of the cassettes stands 21 and of discharging each tablet housed in the interior of the tablet cassettes 22 by rotating a rotator established in the interior of the tablet cassettes 22 through an embodied motor.

The user information input unit 30 is established on the exterior of the body and inputs user information into the controller 7 for authenticating a user of the semi-automatic medicine packaging machine.

The user information input unit 30 consists of a card reader 31 that is established on the front of the body 1 and inputs a user's card information into the controller 7. Alternatively, a biometric identifier that recognizes a user's biometric information like a fingerprint, an iris or a voice may be used, or the button operation unit 8 may be used to input user information like personal identification numbers or passwords.

The controller 7 includes a user authentication unit that authenticates a user by comparing and analyzing user information inputted by the user information unit 30 and information stored in advance. The user authentication unit judges whether a user is an authenticated person or not and allows only an authenticated user to perform operation of the automatic medicine packaging machine through the button operation unit 8.

The semi-automatic medicine packaging machine further includes an information display unit 40 that is established on the front upper part of the shelf 10 and displays information inputted from the controller.

The information display unit 40 corresponds to a liquid crystal display apparatus or a dot matrix printer that displays letters and numbers and lets a user recognize overall information of the semi-automatic medicine packaging machine displayed by letters and numbers, that is, information on current operational state of the semi-automatic medicine packaging machine, on medications for making packages, or on the tablet cassettes 22 that need supplement.

The semi-automatic medicine packaging machine further includes a subsidiary shelf 50 that is established on a side of the shelf 10 as a state of being empty and has a door 51 on the front side. The subsidiary shelf 50 plays a role of forming a collection space for collecting and preserving medications that will be used in case of manual prescription compounding of a pharmacist.

The manual dispensing tray 2 further includes a tray cover 2*a* that is established on the upper part of the tray and is capable of being opened or closed and prevents influx of foreign material into the interior of the manual dispensing tray 2.

Figure 4:
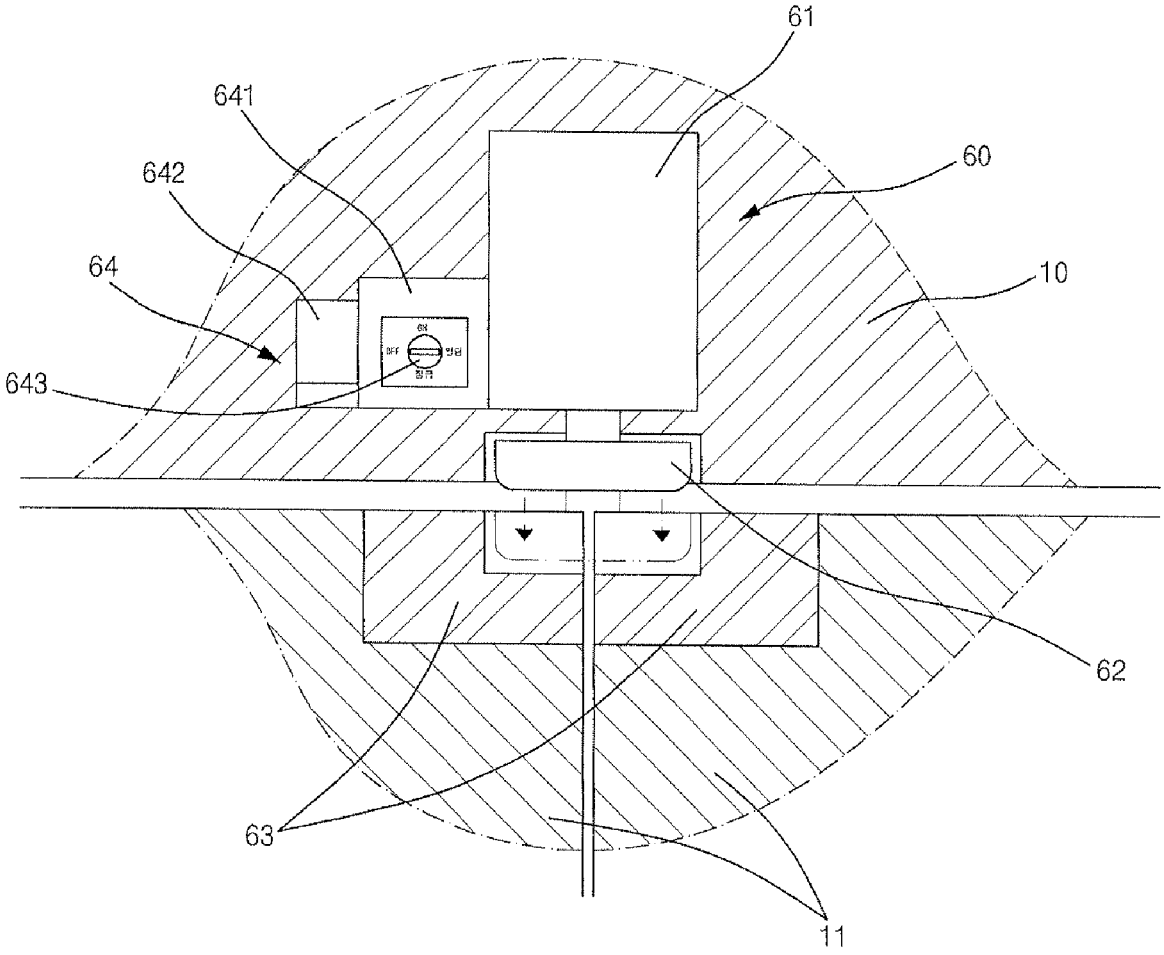
FIG. 4 is an enlarged partial elevation view of the semi-automatic medicine packaging machine.
Figure 5:
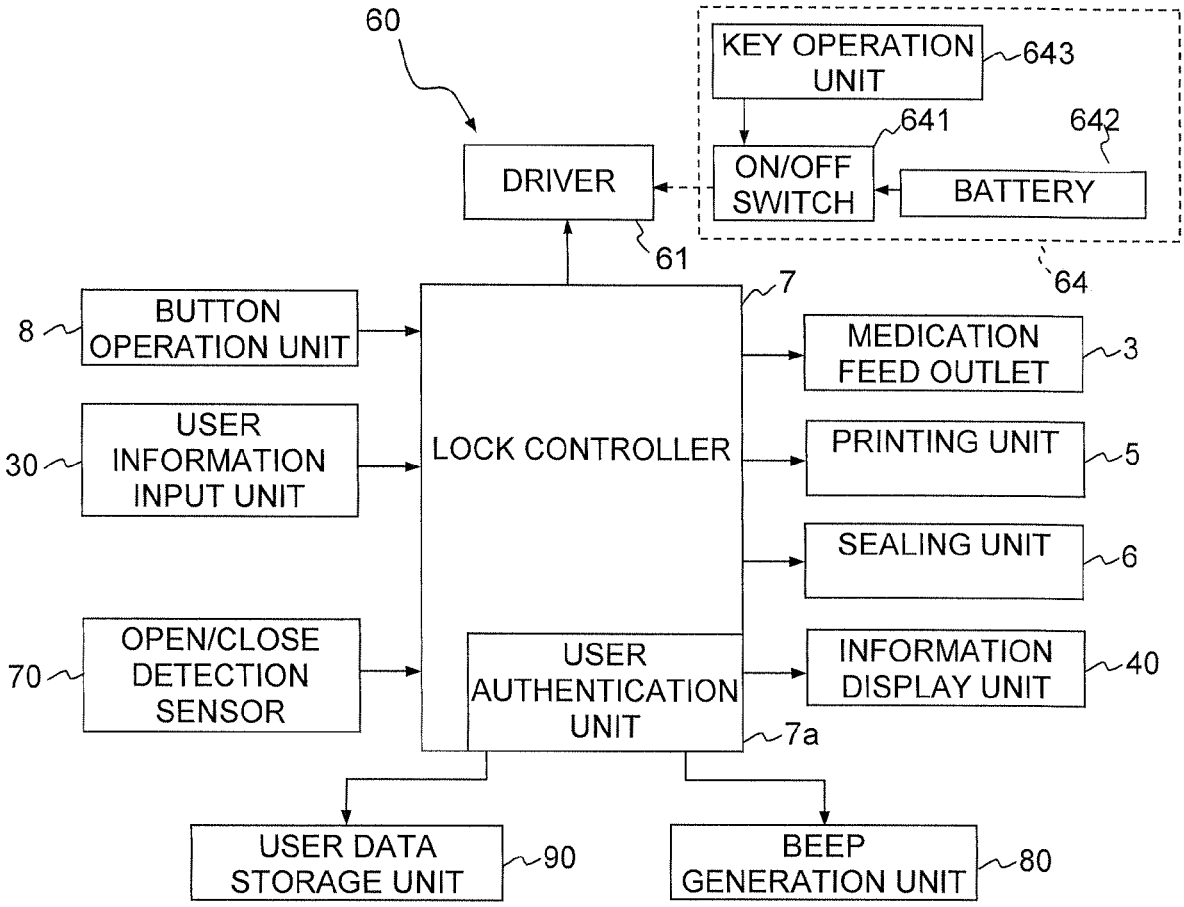
FIG. 5 is a block diagram for the semi-automatic medicine packaging machine.
Figure 6:
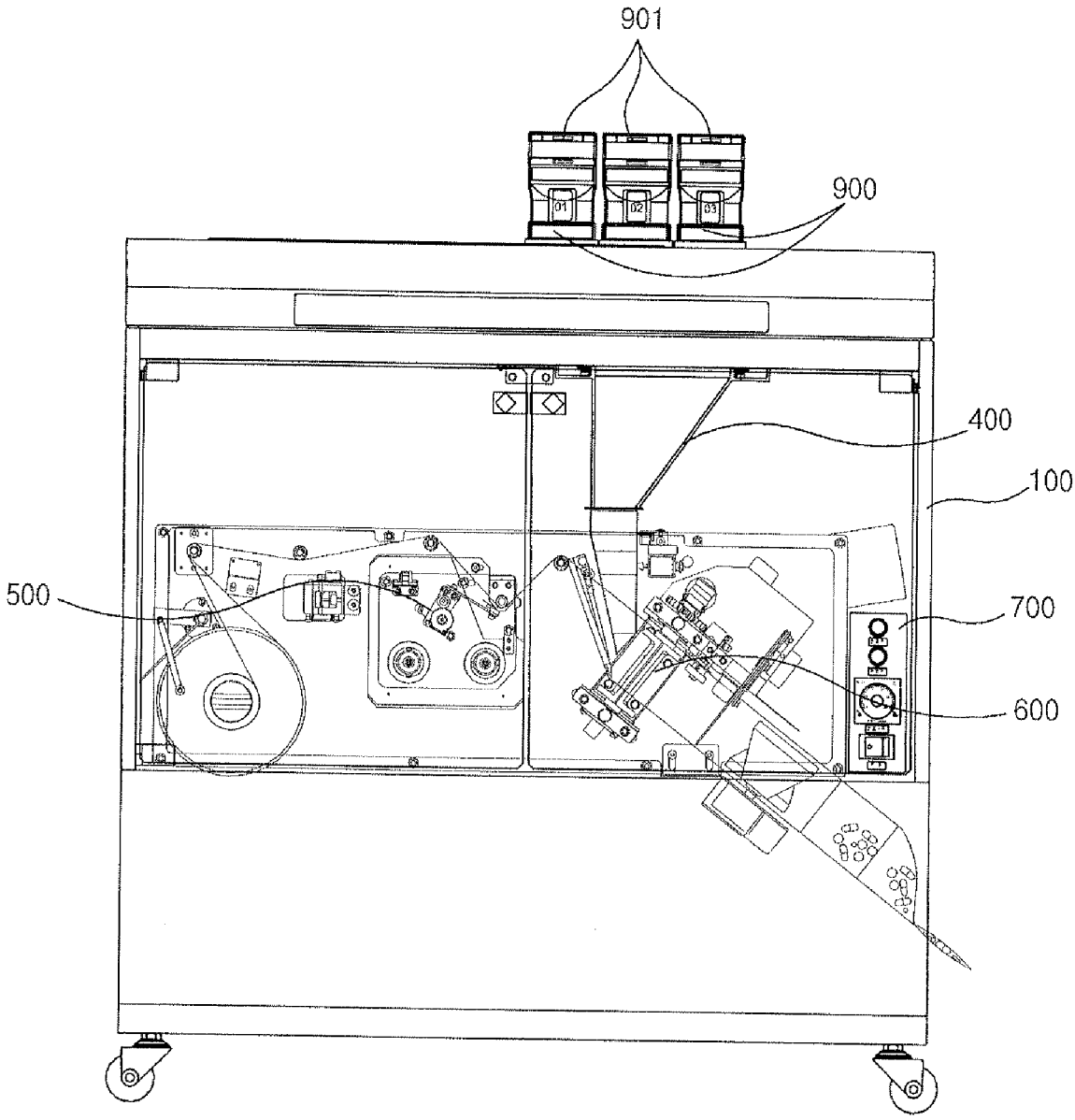
FIG. 6 is an elevation view of a semi-automatic medicine packaging machine by prior art.
Figure 7:
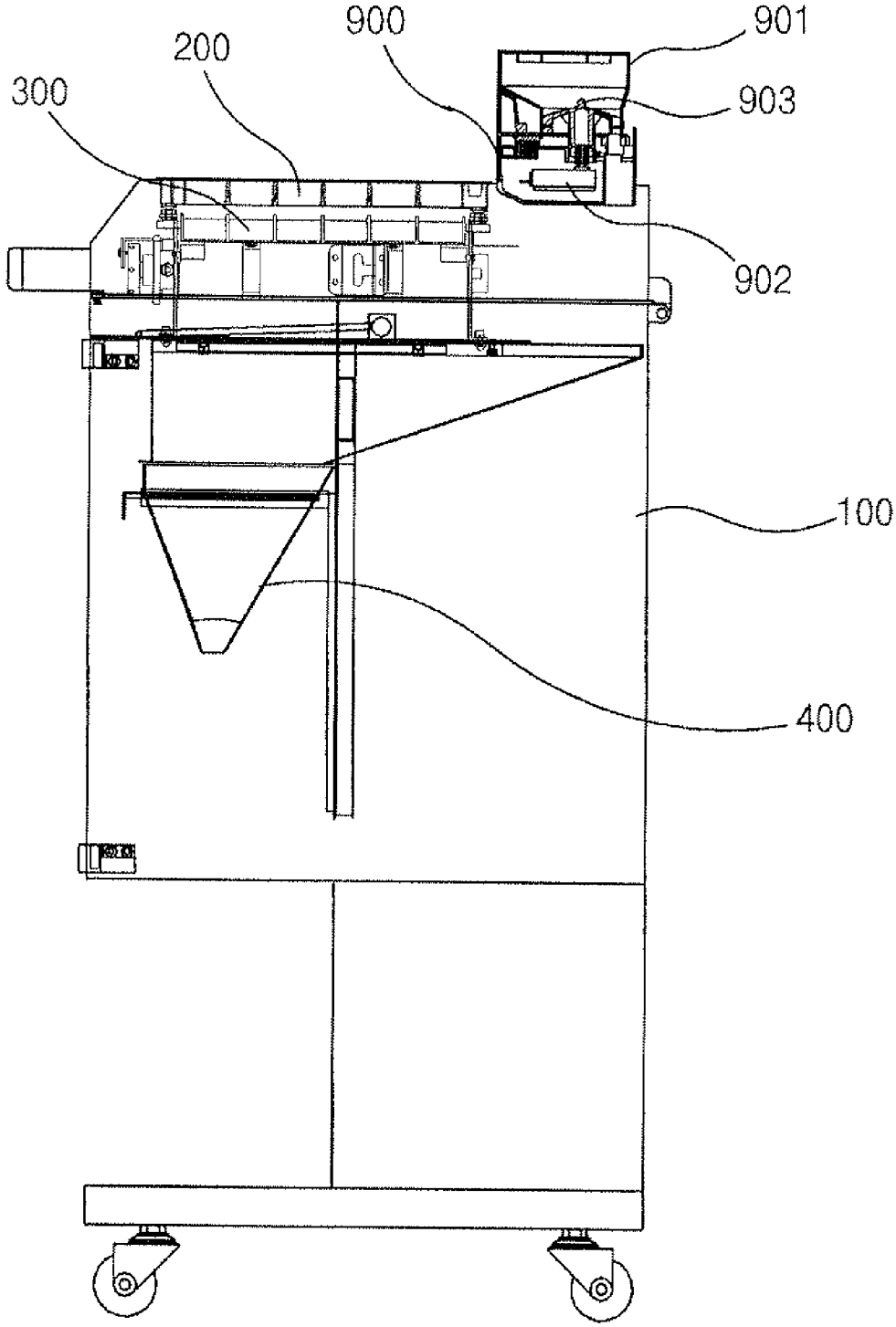
FIG. 7 is a side elevation view of the semi-automatic medicine packaging machine by prior art.
Figure 8:
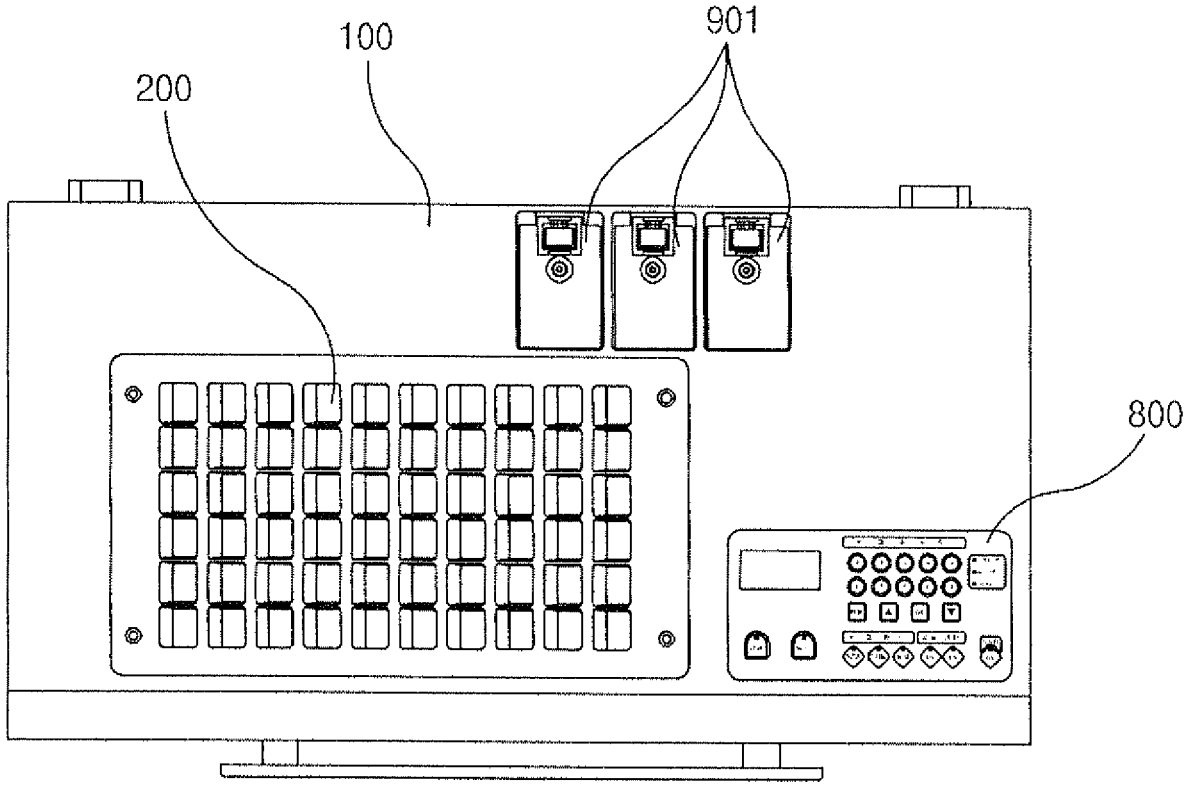
FIG. 8 is a plan view of the semi-automatic medicine packaging machine by prior art.

Referring to FIG. 4 and FIG. 5, the semi-automatic medicine packaging machine further includes the door lock unit 60 that locks or unlocks the glass door 11 of the shelf 10 according to an operation command through the button operation unit 8 by a user authenticated by the user authentication unit 7*a* and prevents an unauthorized user from supplement of medications into or outflow of medications from the tablet cassettes 22 established in the interior of the shelf 10.

The door lock unit 60 includes a driver 61 that is established in the shelf 10 corresponding to the lower part of the glass door 11 and controlled by the controller 7, an anchor member 62 that locks or unlocks the glass door 11 by being vertically moved by the driver 61, and a groove member 63 that is established on the upper part of the glass door 11 corresponding to the lower part of the anchor member 62.

If an authorized user inputs a locking signal into the controller 7 through the button operation unit 8, then the controller 7 operates the driver 61 to insert the anchor member 12 into the groove member 63, and hence the glass door 11 can be solidly fixed by the anchor member 62.

Conversely, if a user inputs an unlocking signal into the controller 7, then the controller 7 operates the driver 61 to pull the anchor member 62 out of the groove member 63, and hence unlocking of the glass door 11 can be accomplished by the anchor member 62.

The door lock unit 60 further includes a manual operation unit 64 that locks or unlocks the door lock unit 60 by manual operation of a user during power failure.

The manual operation unit 64 allows manual operation of locking or unlocking of the door lock unit 60 by a user with a key in case of unexpected power failure in the automatic medicine packaging machine.

The manual operation unit 64 includes an on/off switch 641 that is established on the shelf 10 as a state of being connected to the driver 64, a battery 642 that is connected to the on/off switch 641 and provides power to the driver 64, and a key operation unit 643 that is exposed outside the shelf 10 and controls the driver's 61 operation of locking or unlocking by turning on/off power to be supplied to the driver 61, which may be done by operating the on/off switch 641 through a key.

When locking or unlocking of the door lock unit 60 may not be performed through the button operation unit 8 in case of power failure, following alternative steps may be sequentially proceeded: a user inserts and rotates a key into the key operation unit 643, power changes from off to on by the on/off switch 641, the door lock unit 60 operates to be unlocked in a state of power on, the door lock unit 60 changes from the operation of unlocking to locking, and finally the door lock unit 60 changes from the operation of locking to power off.

In other words, if a user operates the on/off switch 641 through the key operation unit 643 by inserting a key into the key operation unit 643, then the on/off switch 641 makes power on/off in between the battery 642 and the driver 64 according to the rotating position of the key, or locking or unlocking of the glass door 11 may be manually performed by controlling operation of the driver 61.

The automatic medicine packaging machine further includes an open/close detection sensor 70 that is established on the shelf 10 corresponding to the glass door 11 and inputs into the controller 7 by detecting a state of the glass door's 11 being locked or unlocked.

The open/close detection sensor 70 is a kind of contact sensor which recognizes a state of being open or close of the glass door 11 through contact or separation of the glass door 11 established in the shelf 10 and the open/close detection sensor 70 enables more precise locking because operation of the door lock unit 60 is done in a state of the glass door's 11 complete closing.

An opening or closing state of the glass door 11 detected by the open/close detection sensor 70 is displayed through the information display unit 40 that is established on the front of the shelf 10, and the information display unit 40 makes locking or unlocking operation of the glass door 11 performed more precisely and conveniently by letting a user smoothly recognize a state of locking or unlocking of the glass door 11.

The automatic medicine packaging machine further includes a beep generation unit 80 that is connected to the controller 7 and makes beep sound for warning in case of abnormal opening of the glass door 11.

The beep generation unit 80 generates a beep by operation of the controller 7 if separation of the glass door 11 is detected by the open/close detection sensor 70 when the glass door 11 is separated by an unauthorized user while the glass door 11 is locked after a locking signal's being inputted by a user.

In other words, the controller 7 judges a state of the glass door's 11 being abnormally opened by an authorized person according to present state and information of the open/close detection sensor 70, and the controller 7 operates the beep operation unit 80 to make a beep.

The automatic medicine packaging machine further includes user data storage unit 90 that is connected to the controller 7 and stores users' data which are authenticated by the user authentication unit 7*a* of the controller 7.

The user data storage unit 90 forms data on the door lock unit's 60 users by sequentially storing information on users who are authenticated by the user authenticated unit 7*a* while being controlled by the controller 7.

The users' data that are stored in the user data storage unit 90 will be displayed on the information display unit 40 according to operation of a user through the button operation unit 8 and makes a user conveniently confirm users of the door lock unit 60.

The controller 7 continuously packages each dose of medication by controlling the medication feed outlet 3, the printing unit 5, and the sealing unit 6 according to user's operation command inputted from the button operation unit 8 and simultaneously does user authentication by user information inputted from the user information input unit 30.

Also, the controller 7 locks or unlocks the glass door 11 by controlling the driver 61 according to user's operation command, controls operations of the beep generation unit 80 and the information display unit 40 according to information on a state of being opened or closed of the glass door 11 inputted by the open/close detection sensor 70, and displays users' data stored in the user data storage unit 90 according to user's operation command.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A semi-automatic medicine packaging machine comprises:

a) a medication feed outlet that feeds and discharges medications into a hopper disposed interiorly of a body;

b) a manual dispensing tray disposed on a front upper surface of the body;

c) a sealing unit that seals medications in the hopper by medication envelope(s);

d) a printing unit that prints data on the medication envelope(s);

e) a controller that controls the medication feed outlet, the printing unit, and the sealing unit;

f) a button operation unit that inputs a user's operation into the controller;

g) a shelf established on a rear upper part of the body and having a glass door that is established on an open front of the shelf for opening or closing the front of the shelf and an outlet rearwards connected to the hopper;

h) an automatic supply unit, which discharges medications into the outlet according to operation of the controller, comprising a plurality of cassette stands arrayed in an interior of the shelf and a plurality of tablet cassettes detachably established on an upper part of the cassette stands for housing medications; and i) a user information input unit that is established on an exterior of the body and inputs user information into the controller;

wherein the controller comprises a user authentication unit that authenticates a user by comparing and analyzing user information inputted by the user information unit and information stored in advance.

2. The semi-automatic medicine packaging machine of claim 1, further comprising an information display unit that is established on a front upper part of the shelf and displays information inputted from the controller.

3. The semi-automatic medicine packaging machine of claim 1, further comprising a subsidiary shelf that is established on a side of the shelf as a state of being empty and has a door on a front side.

4. The semi-automatic medicine packaging machine of claim 1, wherein the manual dispensing tray further comprises a tray cover that is established on an upper part of the manual dispensing tray and is capable of being opened or closed.

5. The semi-automatic medicine packaging machine of claim 1, wherein the user information input unit comprises a card reader that is established on a front of the body and inputs user's card information.

6. The semi-automatic medicine packaging machine of claim 1, further comprising a door lock unit that is established on the shelf and locks or unlocks the glass door according to the operation through the button operation unit by a user authenticated by the user authentication unit.

7. The semi-automatic medicine packaging machine of claim 6, wherein the door lock unit comprises:

a) a driver that is established on the upper part of the shelf corresponding to a lower part of the glass door and controlled by the controller; and b) an anchor member that locks or unlocks the glass door by being vertically moved by the driver.

8. The semi-automatic medicine packaging machine of claim 7, wherein the door lock unit further comprises a groove member that is established on a upper part of the glass door corresponding to a lower part of the anchor member and makes the anchor member to be inserted into or pulled out of the groove member.

9. The semi-automatic medicine packaging machine of claim 7, wherein the door lock unit further comprises a manual operation unit that locks or unlocks the door lock unit by manual operation of a user during power failure.

10. The semi-automatic medicine packaging machine of claim 9, wherein the manual operation unit comprises:

a) an on/off switch that is established on the body as a state of being connected to the driver;

b) a battery that is connected to the on/off switch and provides power to the driver; and c) a key operation unit that is exposed outside the body and controls the driver's operation of locking or unlocking by switching on or off power to be supplied to the driver through key operation.

11. The semi-automatic medicine packaging machine of claim 1, further comprising an open/close detection sensor that is established on a upper part of the glass door of the shelf and inputs to the controller by detecting a state of the glass door's being locked or unlocked.

12. The semi-automatic medicine packaging machine of claim 11, further comprising a beep generation unit that is connected to the lock controller and makes beep sounds for warning in case of abnormal opening of the glass door.

13. The semi-automatic medicine packaging machine of claim 1, further comprising user data storage unit that is connected to the controller and stores users' data which are information on users who are authenticated by the user authentication unit.

* * * * *